US010400411B2

(12) United States Patent
Warner et al.

(10) Patent No.: US 10,400,411 B2
(45) Date of Patent: Sep. 3, 2019

(54) STRUCTURE WITH SUPPORTING INFLATABLE BEAM MEMBERS, AND METHOD FOR CONTAINING AND RECOVERING HYDROCARBONS OR TOXIC FLUIDS LEAKING FROM A COMPROMISED SUB-SEA STRUCTURE

(71) Applicant: DYNAMIC SHELTERS INC., Calgary (CA)

(72) Inventors: Harold Warner, Calgary (CA); Aaron Knape, Calgary (CA)

(73) Assignee: Dynamic Shelters Inc., Calgary (CA)

( * ) Notice: Subject to any disclaimer, the term of this patent is extended or adjusted under 35 U.S.C. 154(b) by 0 days.

(21) Appl. No.: 15/144,321

(22) Filed: May 2, 2016

(65) Prior Publication Data

US 2017/0298587 A1 Oct. 19, 2017

(30) Foreign Application Priority Data

Apr. 14, 2016 (CA) ..... 2927192

(51) Int. Cl.
*E02B 15/08* (2006.01)
*E02B 15/06* (2006.01)
(Continued)

(52) U.S. Cl.
CPC ..... *E02B 15/0864* (2013.01); *E02B 15/06* (2013.01); *E02B 15/0814* (2013.01);
(Continued)

(58) Field of Classification Search
CPC ..... E04H 15/20; E04H 2015/201; E02B 15/0814; E02B 15/0857; E02B 15/0864;
(Continued)

(56) References Cited

U.S. PATENT DOCUMENTS 547,119 A * 10/1895 Heaton et al. ..... E04H 15/20 135/118
2,297,150 A * 9/1942 Hunter ..... E04H 15/20 135/906

(Continued)

FOREIGN PATENT DOCUMENTS

EP 0494053 A1 7/1992
GB 2396335 A 6/2004

OTHER PUBLICATIONS

Extended European Search Report issued in corresponding European Application No. 17166531.8 dated Jun. 19, 2017 (8 pages).

*Primary Examiner* — Tara Mayo-Pinnock
(74) *Attorney, Agent, or Firm* — Osha Liang LLP

(57) ABSTRACT

A resiliently deformable containment structure having an open bottom end and a raised center portion. A central hub, situated centrally in a textile containment sheet, is provided. A plurality of elongate inflatable beam members are arranged circumferentially around the central hub, each extending radially outwardly and in a downwardly-extending manner therefrom and each underlying or overlying the textile containment sheet to support, when inflated, the textile containment sheet in a downwardly-extending shape to form an enclosure having an open bottom end. Distal ends of the inflatable beam members are tethered to one or more anchor members situated below the open bottom end of the dome structure. The structure is suited for placement above and over a compromised sub-sea structure for collecting and recovering to surface fluids which may be leaking therefrom. A method for containing and recovering such fluids from a compromised sub-sea structure is further disclosed.

26 Claims, 11 Drawing Sheets

(51) Int. Cl.

| | |
|---|---|
| ***E21B 17/01*** | (2006.01) |
| ***E04H 15/20*** | (2006.01) |
| ***E21B 43/01*** | (2006.01) |
| *E02B 15/00* | (2006.01) |

(52) U.S. Cl.
CPC ..... *E04H 15/20* (2013.01); *E21B 17/01* (2013.01); *E21B 43/0122* (2013.01); *E02B 2015/005* (2013.01); *E02D 2600/30* (2013.01); *E04H 2015/201* (2013.01)

(58) Field of Classification Search
CPC ..... E02B 15/0871; E02B 15/0085; E02B 15/0892
See application file for complete search history.

(56) References Cited

U.S. PATENT DOCUMENTS

| | | | | | |
|---|---|---|---|---|---|
| 2,383,840 | A * | 8/1945 | Benckert | B65D 88/78 | 114/257 |
| 2,837,101 | A | 6/1958 | Bary | | |
| 3,389,559 | A * | 6/1968 | Logan | E21B 43/0122 | 137/312 |
| 3,653,215 | A * | 4/1972 | Crucet | E21B 43/0122 | 210/121 |
| 3,664,136 | A * | 5/1972 | Laval, Jr. | E21B 43/0122 | 405/60 |
| 3,675,427 | A * | 7/1972 | Hix, Jr. | B65D 88/78 | 114/257 |
| 3,824,942 | A * | 7/1974 | Stafford | B65D 88/78 | 405/210 |
| 3,875,753 | A * | 4/1975 | Ehlers | B63C 11/44 | 405/185 |
| 3,981,154 | A * | 9/1976 | Hix, Jr. | B65D 88/78 | 405/210 |
| 3,999,333 | A * | 12/1976 | Amarantos | E04H 15/20 | 52/2.19 |
| 4,876,829 | A * | 10/1989 | Mattick | E04H 15/20 | 135/125 |
| 5,570,544 | A | 11/1996 | Hale et al. | | |
| 5,964,767 | A | 10/1999 | Tapia et al. | | |
| 6,019,112 | A | 2/2000 | Matlock | | |
| 6,192,633 | B1 * | 2/2001 | Hilbert | E04H 1/1277 | 52/2.18 |
| 6,592,299 | B1 * | 7/2003 | Becker | E03L 33/06 | 405/210 |
| D510,118 | S * | 9/2005 | Smith | D21/834 | |
| 7,176,876 | B2 | 2/2007 | Kabuto et al. | | |
| 8,523,482 | B1 * | 9/2013 | Watson, Sr. | E21B 43/0122 | 405/210 |
| 8,991,104 | B2 | 3/2015 | Warner et al. | | |
| 9,267,765 | B2 | 2/2016 | Warner et al. | | |
| 2009/0249701 | A1 * | 10/2009 | Turcot | E04H 15/20 | 52/2.18 |

* cited by examiner

STRUCTURE WITH SUPPORTING INFLATABLE BEAM MEMBERS, AND METHOD FOR CONTAINING AND RECOVERING HYDROCARBONS OR TOXIC FLUIDS LEAKING FROM A COMPROMISED SUB-SEA STRUCTURE

FIELD OF THE INVENTION

The present invention relates to inflatable structures, and more particularly to an inflatable containment structure, and a method using such inflatable containment structure for recovering hydrocarbons or toxic fluids, or mixtures of both, from a compromised sub-sea structure.

BACKGROUND OF THE INVENTION

Above-ground inflatable structures/enclosures for sheltering humans and or the contents of such structure and which utilize inflatable supporting beams supporting a flexible skin or sheeting, are generally known.

Commonly-assigned U.S. Pat. No. 9,267,765 teaches one such structure/enclosure which has inflatable supporting beams, which are inflated with air. The structure/enclosure, due to the resilient flexibility of the inflatable beams, produces a structure/enclosure that is specially adapted for an environment such as a war zone, where the structure/enclosure need be resiliently flexible and not totally rigid to thereby better withstand blast waves emanating from ordinance exploding nearby. Vertical flexible tethermasts assist in securing and tethering the inflatable beams. Such tethermasts may be secured together by horizontal support members. An external fly may further be provided.

U.S. Pat. No. 5,570,544 teaches an air-inflatable frame(s) which provide a structure for supporting an external sheeting, to thereby provide inter alia a supported tent structure. The inflatable frames are provided with restraint members which prevent full extension of the inflatable air beams upon inflation thereof, and serve to cause the inflatable frame to assume a desired predefined polygonal shape of the tent.

EP 0494053 teaches an above-ground semi-cylindrical shed or hanger, such as for sheltering an aircraft during maintenance thereon, such hanger having a plurality of supporting arches consisting of inflatable tubular members. Wind bracing elements, in the form of guy wires 15, 17, are disposed on the outside of the arches. A covering sheet is disposed above the supporting structure formed by the plurality of parallel juxtaposed supporting arches.

U.S. Pat. No. 2,837,101 teaches, in one embodiment thereof (FIG. 1) an igloo-type enclosure having inflatable tubular wall elements 32 of progressively varying radii to provide a hemispherical or dome-like roof. A floor section 20 is provided, with stakes 21 for securing the floor section to the ground. The roof is supported by a pair upright poles 26, having a cord 27 extending therebetween and secured at 26 to the crown of the hemispherical roof to provide support and suspend the roof therefrom.

U.S. Pat. No. 6,019,112 to a Home Greenhouse Kit teaches a greenhouse having a semi-circular housing formed by two layers of flexible sheeting and a plurality of elongated parallel rib channels having inflatable tubes therein which are situated between the two layers. A floor portion forms a base and is connected to the housing portion.

U.S. Pat. No. 5,964,767 to a Chemical, Biological Explosive Containment System teaches a plurality of inflatable air beams having a truncated hexagonal pyramid shape, which may be placed over a bomb, IED, or other explosive device which need be detonated so as to neutralize it. A bomb containment blanket 20 is arranged parabolically within the air beam suspension support structure in a tent-like fashion. The containment blanket 20 is attached to the inflatable support structure with a rope or cord. The bomb containment blanket 20 further possess an access portal 21 to allow hazard mitigation foams to be delivered inside the explosion containment/hazard mitigation region 12 within the bomb containment blanket.

Commonly-assigned U.S. Pat. No. 8,991,104 to a "Method and Apparatus for Distributing a Load about an Air Beam" teaches an air beam supported structure/enclosure, further teaching an air beam sling or hug strap for distributing loads to/from the individual air beams.

Also teaching ways and means for distributing loads to and from air beams, U.S. Pat. No. 7,176,876 teaches an alternative means of coupling to an air beam, using permanently-affixed laceloops, to allow application/distribution of loads thereto.

In addition, it is known to construct, on a seabed floor, a subsea structure of rigid materials surrounding a compromised structure such as a leaking oilwell or pipeline, to collect oil leaking from such structure and by means of tubing pump such collected oil to surface.

The above background information is provided for the purpose of making known information believed by the applicant to be of possible relevance to the present invention. No admission is necessarily intended, nor should be construed, that any of the preceding information, or the reference in the drawings to "prior art" constitutes prior art citable against the present invention.

Disadvantageously, however, as regards the aforementioned undersea structures of rigid materials and construction, due to their rigid and non-deformable nature such are frequently destroyed and/or their containment capacity seriously compromised when they are exposed to transitory but severe undersea pressure waves caused by, typically, undersea earthquakes.

As regards the aforementioned inflatable air beam structures, none of the above art teaches, alone or in combination, in the manner more fully particularized herein, a resiliently deformable structure having a central hub at an apex or crown of such structure and a plurality of elongate inflatable beam members extending radially outwardly and downwardly therefrom, which beam members overly or underly a textile sheet member to thereby support such sheet member in the form an enclosure. Specifically, none of the aforementioned prior art teach or suggest a structure is particularly suitable for use undersea in collecting and recovering leaking fluids from a compromised undersea vessel or structure and further capable of withstanding transitory but nonetheless large pressure forces which may occur in areas of the ocean where, for example, there are large undersea currents and/or large pressure waves generated for example by undersea earthquakes.

Nor do any of such prior art structures suggest the affixing of a riser to a central hub mounted on the crown or apex of the resiliently flexible structure, to allow withdrawing of fluid collected from within such enclosure to be pumped to surface and thus recovered.

Nor for that matter does the prior art suggest or teach a method of being able to deploy a structure subsea which is capable of collecting and recovering leaking fluids to surface, yet still being able to withstand large transitory pressure waves which may be present.

SUMMARY OF THE INVENTION

In order to provide a containment structure particularly suited for the uses set out herein, and more particularly inter alia for undersea use in collecting and recovering fluids undersea which are leaking from a compromised sunken oil transport vessel or structure such as leaking oil well or pipeline in harsh environmental conditions, in a first broad embodiment the invention is directed to a containment structure which is not only easily portable and deployable but more importantly is resiliently deformable to withstand large localized disturbances, such as undersea earthquakes, tidal and thermal convection, and the tsunami-type waves and forces generated by such undersea disturbances.

Specifically, not only does the present containment structure to be easily and relatively quickly transported in an uninflated condition and thereafter positioned and inflated about a compromised vessel on a seabed floor, but such containment structure is further capable of being resiliently deformed when exposed to transient pressure forces yet nonetheless retain structural integrity and return to its original and desired shape to thereby serve its intended function.

The ability of the containment structure of the present invention to partially deform is particularly advantageous for a containment structure, as such may not infrequently, particularly in a sub-sea environment, be exposed to transitory pressure waves/forces exerted on one or more sides of such structure. The ability to resiliently deform and thereafter return to its original shape and position above a compromised structure sitting on a seabed floor and allowing the continued collection and pumping to surface of collected leaking fluids is particularly desirous and important feature of the present invention.

Accordingly, in order to realize one or more of the above advantages, the containment structure of the present invention in a broad embodiment comprises:

(i) a textile containment sheet substantially impervious to a first fluid;

(ii) a central hub situated centrally on said textile containment sheet and having an outer periphery;

(iii) a plurality of elongate inflatable beam members, first longitudinal ends thereof arranged circumferentially around said outer periphery of said central hub, said inflatable beam members each extending radially outwardly and in a downwardly-extending manner from said central hub and each underlying or overlying said textile containment sheet and each coupled to said textile containment sheet at one or more intervals or continuously along a longitudinal length of each of said inflatable beam members and thereby supporting said textile containment sheet;

(iv) one or more anchor members, each of said plurality of inflatable beam members proximate a second longitudinal end thereof opposite said first longitudinal end being tethered, via rope, cable, or chain members, to said one or more anchor members; and (v) a fluid exit port located in or at said central hub, for removing said first fluid from within said containment structure;

wherein said inflatable beam members, when inflated with a second fluid and when said second longitudinal ends thereof are tethered to said one or more anchor members, together support said textile containment sheet in a downwardly-extending shape extending downwardly from said raised central hub, to form an enclosure having an open bottom end.

In a refinement thereof, the invention is particularly directed to a hemispherical sub-sea dome containment structure for containing and temporarily collecting therewithin leaking fluids such oil and hydrocarbon gases such as methane, propanes, and the like and/or other fluids such as toxic fluids which are escaping from a compromised under-sea structure such as an undersea pipeline, under-sea valve, under-sea oil well, or sunken transport ship. Such hemispherical sub-sea dome structure in such instance comprises:

(i) a textile containment sheet substantially impermeable to a first fluid being collected;

(ii) a central hub, having an cylindrical outer periphery, situated centrally on or within said textile containment sheet;

(iii) a plurality of elongate inflatable beam members each having a first longitudinal end and arranged circumferentially around said cylindrical outer periphery of said central hub, said inflatable beam members each extending radially outwardly and in a downwardly-curved manner from said central hub and each underlying or overlying said textile containment sheet and coupled thereto at discrete points along a longitudinal length of each inflatable beam member for supporting said textile containment sheet in a downwardly-curved hemispherical dome shape to form a hemispherical enclosure having an open bottom end;

(iv) one or more anchor members disposed in spaced relation about a circular base portion of said textile containment sheet, said one or more anchor members tethered to one or more of said inflatable beam members proximate a second longitudinal end thereof opposite said first longitudinal end;

wherein said plurality of inflatable beam members, when inflated with a second fluid and when said second longitudinal ends thereof are tethered to said one or more anchor members, together support said textile containment sheet in said hemispherical dome shape.

The shape of the containment structure, namely having a raised central portion at the central hub, such as, for example, a hemisphere, cone, or polyhedron shape and having the center portion at the crown or apex thereof and having an open bottom end, is particularly useful in that such containment structure via its open (underside) base, allows ingress of the leaking fluids (typically escaping from a compromised subsea structure lying on the ocean floor) into the enclosure thereof via the bottom end, and removal of collected fluids via the fluid exit port at the crown or apex.

Advantageously, such shape of the containment structure utilizes a physical property of the leaking fluid(s) from compromised undersea structures (which is typically oil and other hydrocarbons in liquid or gaseous form which are escaping from a ruptured or leaking vessel or undersea structure such as an oilwell or pipeline), namely that such leaking hydrocarbons are typically substantially lighter (i.e. of less density) than the surrounding sea water. Thus in such cases the containment structure shape advantageously further allows the leaking fluids collected therewithin [such fluids, such as oil and gases which all have a lower density than water] to rise to the top (crown or apex) of the enclosure, simultaneously displacing any water and allowing the hydrcarbons to thereafter be removed from the crown/apex of the enclosure substantially free of water, via a riser coupled to a fluid exit port situated in the central hub, and thereafter be pumped to surface.

Specifically, the containment configuration advantageously serves to forcibly separate, due to the force exerted by collected hydrocarbons rising therein, water from fluids flowing into the enclosure by displacing any water within the dome downwardly and away from the riser and toward the bottom open base of the enclosure dome. The (lighter) rising hydrocarbons can then be collected from the crown/ apex of the structure without entrained water, thus reducing [and to a substantial extent eliminating, depending on the rate of flow of the first fluid into the hemispherical dome and the rate at which such first fluid is pumped from the dome] undesired seawater being recovered to surface.

The inflatable beam members are typically inflated by a second fluid, typically water, but such second fluid may be air, nitrogen, carbon dioxide, or a mixture of any or all of the foregoing with water, which is pumped or injected into an interior of the inflatable beam members. The second fluid may, but preferably is not, the same as the first fluid, and as indicated above, is preferably water.

Due to the inflatable beam members being constructed of a fixed interior volume, inflation with the second fluid causes the beam members to assume their desired intended shape. Distortion of such beam members from such desired initial shape and fixed interior volume is thereby resisted, due to the maximum volume of the beam member being in its intended, undeflected state/configuration.

Typically, the fluid by which the inflatable beams are inflated, particularly when the resulting containment structure used in subsea applications, is ocean water. Since water, including ocean water, is incompressible, inflation of the beam members may be further accompanied by injection of a gas such as air, carbon dioxide, or nitrogen so as to further pressurize the inflatable beam members. Such injected gas may be entrained with the water when the beam members are being inflated, or may be injected separately before or after inflation with water.

Individual beam members may, in one embodiment of the invention, be provided with a fluid receptacle for injection of the second fluid. Such fluid receptacle is in fluid communication with an interior of a corresponding beam member, and has a fluid coupling to allow temporary communication with a supply hose containing the second fluid. The receptacle may further possesses a one-way valve to allow a supply of pumped fluids to be provided, yet once injected, to be retained within each inflatable beam member. The second fluids being injected may be provided via a mating fluid coupling at a distal end of a fluid supply hose. An undersea vehicle may manipulate a fluid supply hose and couple same to each receptacle on each beam member to successively inflate such beam members when the hemispherical dome structure of the present invention is submersed undersea. Alternatively, the beam members may be inflated at surface, and the resulting hemispherical structure/enclosure thereafter lowered in place over the compromised subsea structure.

Alternatively, however, in a preferred embodiment of the above containment structure of the present invention the central hub further has port means located on the cylindrical outer periphery thereof which is configured to act as a manifold to provide and distribute the second fluid to an interior of at least one, and preferably each, of the inflatable beam members, for inflating such beam members. In a further refinement of such alternative preferred embodiment the port means comprises a plurality of ports corresponding in number to the plurality of inflatable beam members, arranged in spaced relation around the cylindrical outer periphery of the central hub. Each of the plurality of ports are configured to provide a second fluid such as water, air, nitrogen, carbon dioxide, or a mixture thereof to an interior of a corresponding of the plurality of inflatable beam members.

In a further preferred embodiment the port means is coupled to a supply of said fluid and configured to provide said fluid to an interior of said inflatable beam members to thereby inflate said inflatable beam members.

In a further preferred embodiment, the port means comprises a plurality of ports spaced about said cylindrical outer periphery of said central hub, said plurality of ports corresponding in number to said plurality of inflatable beam members and each of said ports coupled to and in fluid communication respectively with a first longitudinal end of corresponding of said plurality of inflatable beam members, said central hub configured to inflate said beam members via said ports when said ports are supplied with said fluid.

Preferrably, in each of the aforesaid embodiments, the central hub is coupled to an elongate fluid supply hose, and the central hub, when supplied with said fluid via said fluid supply hose, is adapted to provide said fluid to an interior of each of said inflatable beam members via said central hub so as to inflate said inflatable beam members. Equally preferably, the central hub may possess a pressure regulator, and the elongate supply hose is an air supply hose. In such embodiment the central hub, when supplied with said air via said air supply hose, is configured to provide air to an interior of each of said inflatable beam members so as to pressurize said inflatable beam members at a uniform pressure.

Inflation of the inflatable beam members, preferably via the ports on the central hub as described above, causes such beam members to become semi-rigid and capable of supporting the textile or fabric containment sheet in the desired shape particularly suited for collecting and trapping low-density leaking fluid centrally within the textile containment sheet.

In a further refinement, the central hub is provided with a plurality one-way valves, each of said plurality of one-way valves allowing flow of said second fluid from within said central hub to a respective of said inflatable beam members, but preventing reverse flow of said second fluid from said inflatable beam members into said central hub.

In a preferred embodiment, the one or more anchor members comprise one or more cast concrete members. In an alternative embodiment, the one or more anchor members may comprise a single, integral, circular member, coupled to the lower portion of the textile fabric sheet and/or the distal ends of each of the inflatable beam members, to thereby ensure the so-formed structure remains tethered immediately above the compromised subsea structure which is leaking fluids.

In a further preferred embodiment, each of the inflatable beam members of the structure are elongate and cylindrical, and are each coupled to the textile containment sheet via points of coupling on a plurality of circumferential strap members disposed along said longitudinal length of each of said inflatable beam members.

In a refinement thereof, the inflatable beam members each have disposed around a portion of a periphery thereof and in spaced-apart relation along said longitudinal length of each, a plurality of circumferential strap members, each inflatable beam member being coupled to said textile containment sheete via a point of coupling on each of said plurality of circumferential strap members thereon.

Other means of coupling the inflatable beam members to the flexible textile or fabric sheet member will now occur to persons of skill in the art, and are accordingly contemplated within the scope of the present invention.

As mentioned above, in a highly-preferred embodiment of the above containment enclosures/structure such further comprises a flexible, hollow, tubular fluid transport riser in fluid communication with an interior of the hemispherical enclosure, configured and of a length sufficient to extend to surface when said containment structure is submerged subsea. Such riser allows transport of the collected leaking fluids from the interior of said enclosure to a vessel situated on the ocean surface.

The tubular fluid transport riser is coupled to the central hub and extends upwardly from the central hub. The central hub has an aperture/fluid exit port therein permitting flow of fluid from within said so-formed enclosure through the central hub member and into said riser.

In another broad aspect of the present invention, such invention comprises a method for containing and recovering a first fluid which is leaking or flowing from a compromised sub-sea structure. Such method comprises the steps of:

(i) arranging at surface a plurality of elongate inflatable beam members circumferentially around an outer periphery of a central hub member such that first longitudinal ends of said inflatable beam members are coupled to said central hub member and second mutually opposite ends of each inflatable beam member extend radially outwardly and downwardly from said central hub member;

(ii) arranging said central hub member and said inflatable beam members such that they underly or overly a textile containment sheet;

(iii) attaching said inflatable beam members to said textile containment sheet at discrete points along a longitudinal length of each inflatable beam member;

(iv) coupling a first end of an elongate tubular riser to said central hub member, while maintaining a second, mutually opposite longitudinal end of said tubular riser at surface;

(v) lowering said textile containment sheet, inflatable beam members, and central hub member within a body of water to at least partially overly a compromised sub-sea structure that is leaking said first fluid into said body of water, so that said textile containment sheet surrounds upper regions of said compromised structure (vi) inflating, after step (iv) or (v), said inflatable beam members with a second fluid to form a containment structure with said central hub member situated at a crown or apex of said containment structure, and flowing said first fluid into regions underlying said textile containment sheet; and (vii) withdrawing, at a location proximate a crown or apex of said containment structure, said first fluid from within an interior of said containment structure via said tubular riser, and pumping said first fluid to surface.

In a preferred embodiment, such method further comprises the step of attaching one or more anchor members which rest on the ocean floor to said second mutually opposite ends of each inflatable beam member, so as to firmly tether the containment structure above the compromised structure.

The step of attaching said one or more anchor members to said second mutually opposite ends of each of said plurality of inflatable beam members may be conducted at surface and prior to lowering said textile containment sheet, said inflatable beam members, and said central hub member within said body of water to overly at least portions of said compromised sub-sea structure.

Alternatively, the step of attaching the anchor means to the second mutually opposite ends of each inflatable beam member is conducted sub sea, after having lowered the textile containment sheet, the inflatable beam members, and the central hub member within said body of water to at least partially overly the compromised sub-sea structure.

Similarly, the inflatable beam members may be inflated with a fluid at surface and prior lowering said textile containment sheet, said inflatable beam members, and said central hub member within said body of water to overly at least a portion of said compromised sub-sea structure.

Alternatively, the inflatable beam members may be inflated subsea after having lowered said textile containment sheet, said inflatable beam members, and central hub member within said body of water so as to at least partially overly said compromised sub-sea structure, and after having attached said anchor means to said second longitudinal ends of said inflatable beam members.

In one embodiment of the present method, the inflatable beam members are inflated with air, water, or a mixture thereof by a submersible undersea vessel, said undersea vessel configured to supply said air, water, or a mixture thereof to a receptacle on one or more of said inflatable beam members, and supplying said air, water, or mixture thereof to said receptacle to thereby inflate said inflatable beam members.

Alternatively, the individual inflatable beam members may be inflated via coupling a fluid supply hose to the central hub member and using the central hub as a manifold and distributing the second fluid supplied via said fluid supply hose to each of the individual beam members.

The above summary of the structure and method of the present invention does not necessarily describe the entire scope of the present invention. Other aspects, features and advantages of the invention will be apparent to those of ordinary skill in the art upon a proper review of the entire description of the invention as a whole, including the drawings and consideration of the specific embodiments of the invention described in the detailed description.

BRIEF DESCRIPTION OF THE DRAWINGS

The following figures depict selected embodiments of the apparatus and method of the present invention. For a full definition of invention, reference is to be had to the specification as a whole, including the Summary of the Invention, the Detailed Description of Some Embodiments, and the claims.

The following Figures are appended, in which.

DETAILED DESCRIPTION OF SOME PREFERRED EMBODIMENTS

Figure 1:
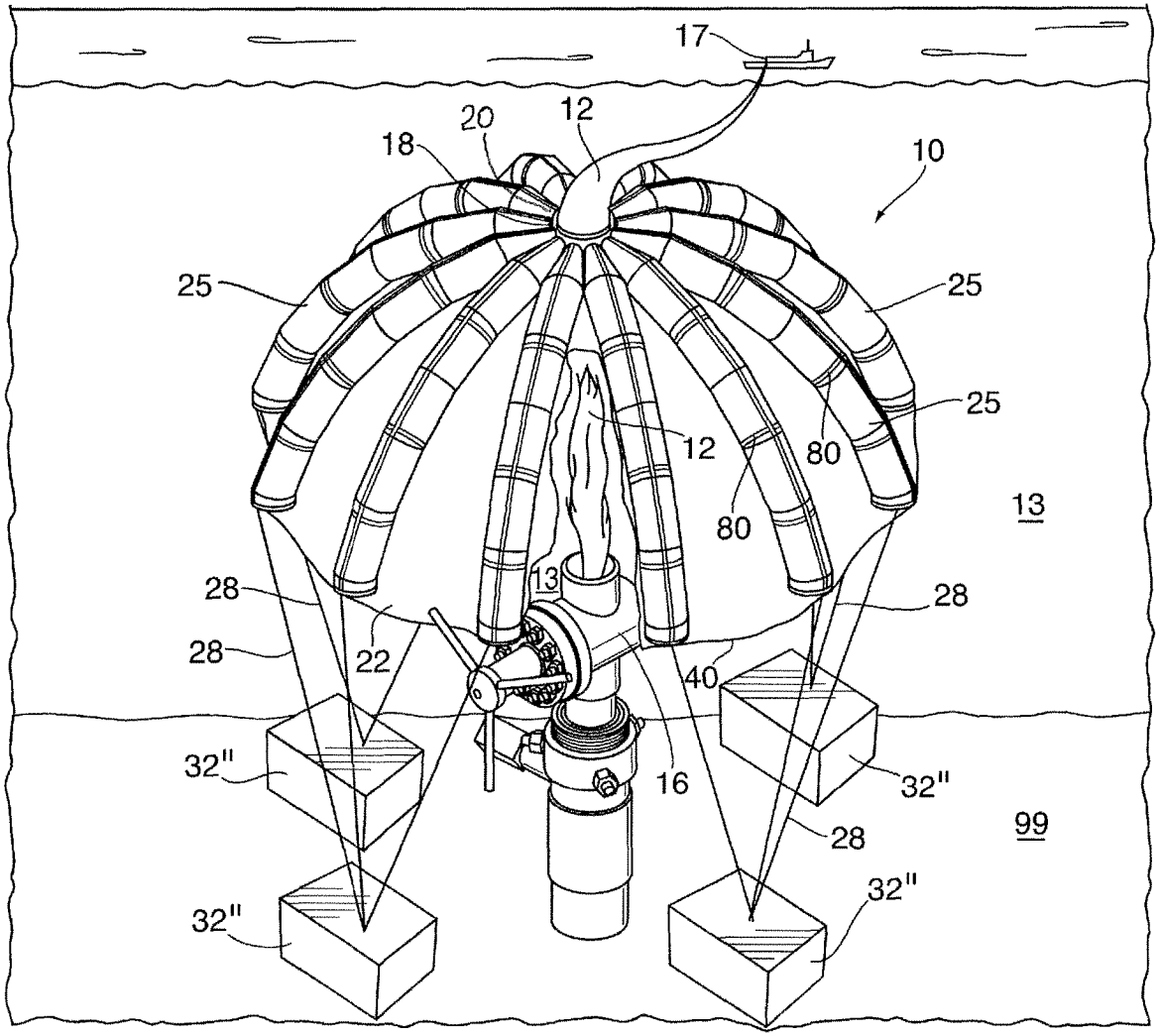
FIG. 1 is a perspective view of the hemispherical dome structure of the present invention and its method of use in an embodiment where such structure is used for collecting oil escaping from a compromised oil well, and the manner allowing for pumping of such collected oil to surface with reduced entrainment of sea water in the collected oil.

FIG. 1 shows one embodiment of the containment structure 10 of the present invention and its method of use in an embodiment where such structure 10 is used for collecting a first fluid 12 (in the embodiment shown, leaking hydrocarbon fluids and gases) escaping from a compromised oil well 16, which results in the separation of collected fluid 12 from surrounding seawater 13 and allows pumping of such collected fluid 12 without enrtrained seawater to a vessel 17 at surface.

Figure 5:
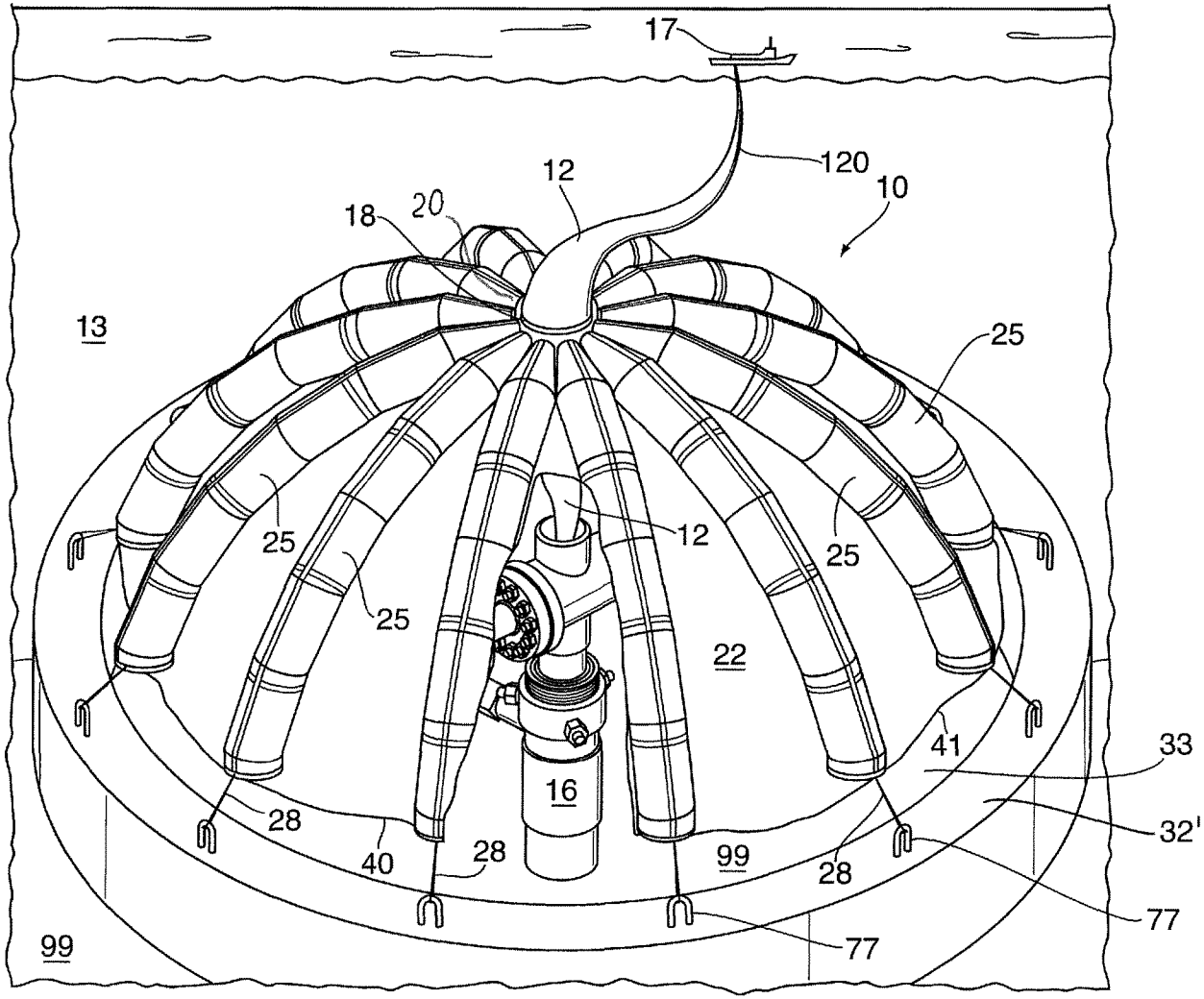
FIG. 5 is a perspective view showing an alternative embodiment of the hemispherical dome structure of the present invention and its method of use in an embodiment where such structure is used for y collecting therewithin oil escaping from a compromised under-sea structure, and the manner for allowing pumping of such collected oil to surface with reduced entrainment of sea water in the collected oil.
Figure 6:
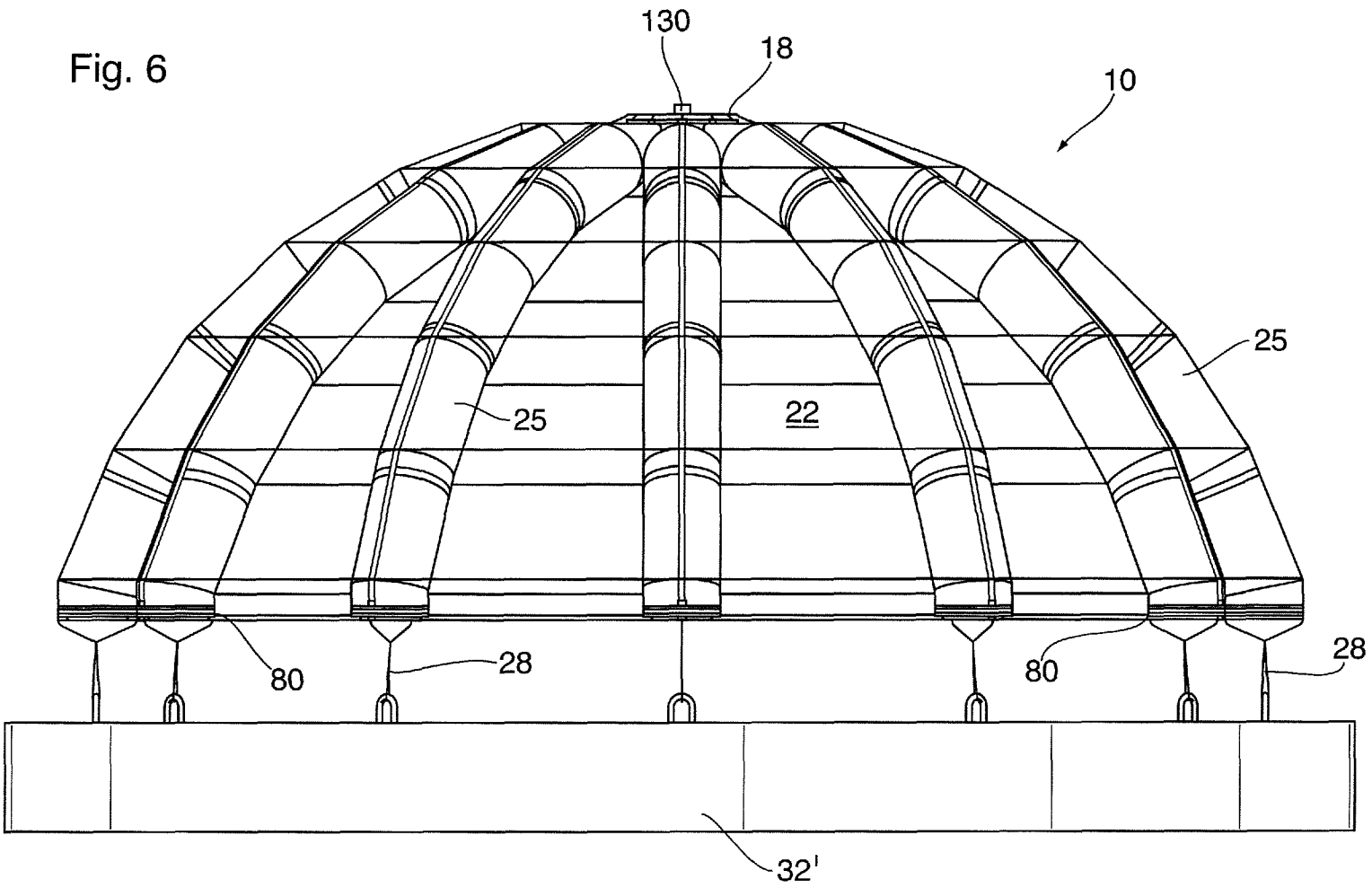
FIG. 6 is a side elevation view of the hemispherical dome structure of FIG. 5, shown without the riser for transporting collected oil from the interior of the hemispherical dome to surface.
Figure 7:
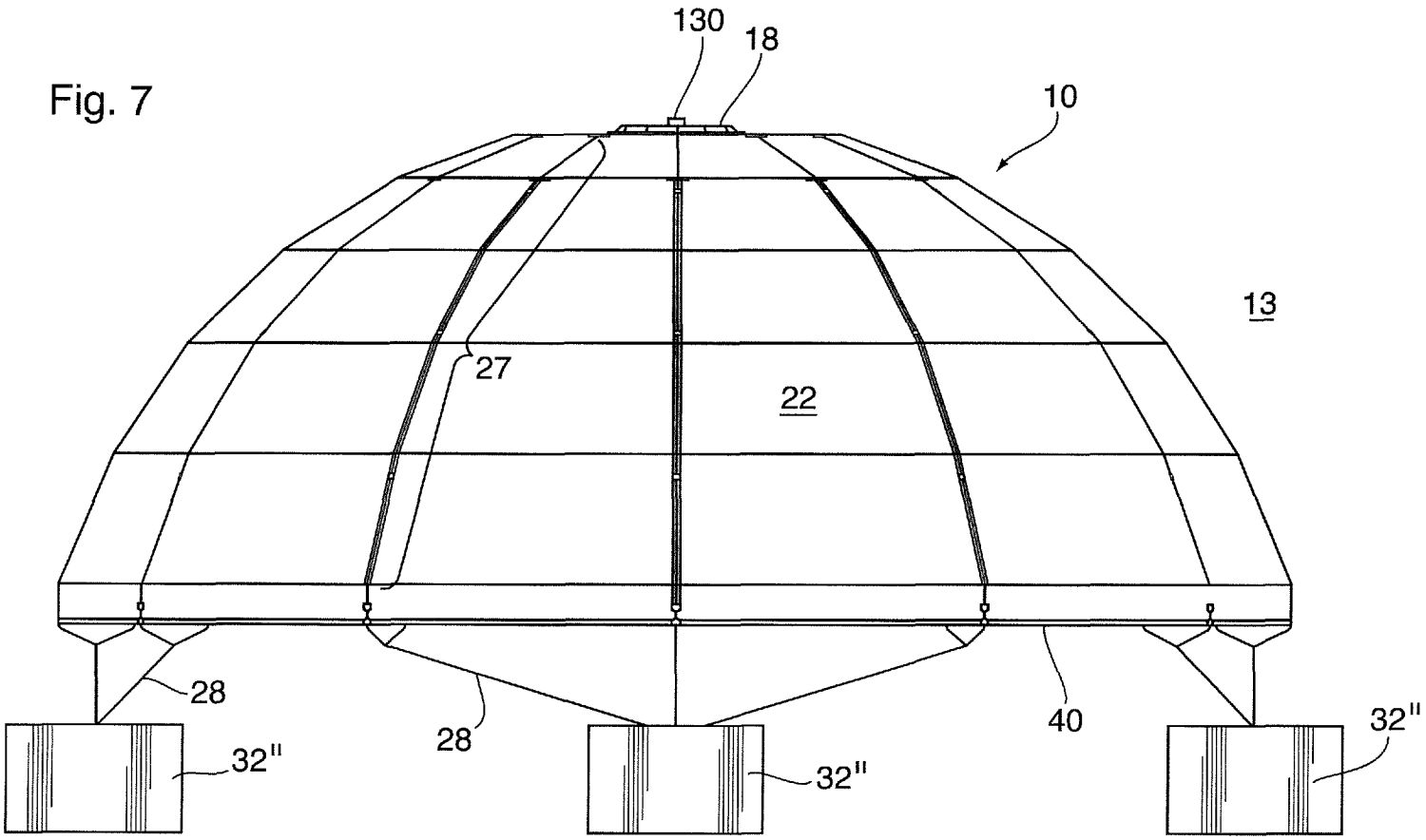
FIG. 7 is a side elevation view of an alternative embodiment of the the hemispherical dome structure of the present invention, wherein the textile containment sheet overlies each of the inflatable beam members.

FIG. 5 shows another embodiment of the containment structure 10 and FIG. 7 shows yet another variation of the hemispherical dome containment structure 10 of the present invention and its method of deployment.

The containment structure 10 shown in each of FIGS. 1 & 5 is shown in a particular use to which it is particularly suited (but not necessarily only capable of being used in), namely as a sub-sea structure for containing and collecting therewithin a first fluid 12, which may take the form of liquid and/or gaseous hydrocarbons which are escaping/leaking from compromised under-sea structure such as capped oil well 16, and displacing seawater 13 within such hemispherical dome 10 to thereby allow such first fluid 12 (to the exclusion or partial exclusion of any surrounding water 13) to be pumped to vessel 17 at surface.

In each of the embodiments shown in FIGS. 1-12, containment structure 10 comprises a central hub member 18 having an outer periphery 20, which central hub 18 is situated centrally on or within a flexible fabric/textile containment sheet 22.

A plurality of elongate, inflatable beam members 25 are provided—first longitudinal ends 26 thereof being arranged circumferentially around outer periphery 20 of hub member 18 and (when inflated) extend radially outwardly and (when tethered to one or more anchor members 32) extend in a downwardly-curved manner from central hub 18.

Inflatable beam members 25 may overlie textile containment sheet 22 as best shown in FIGS. 2-6, or alternatively may underlie textile containment sheet 22 as shown in FIG. 7.

Figure 2:
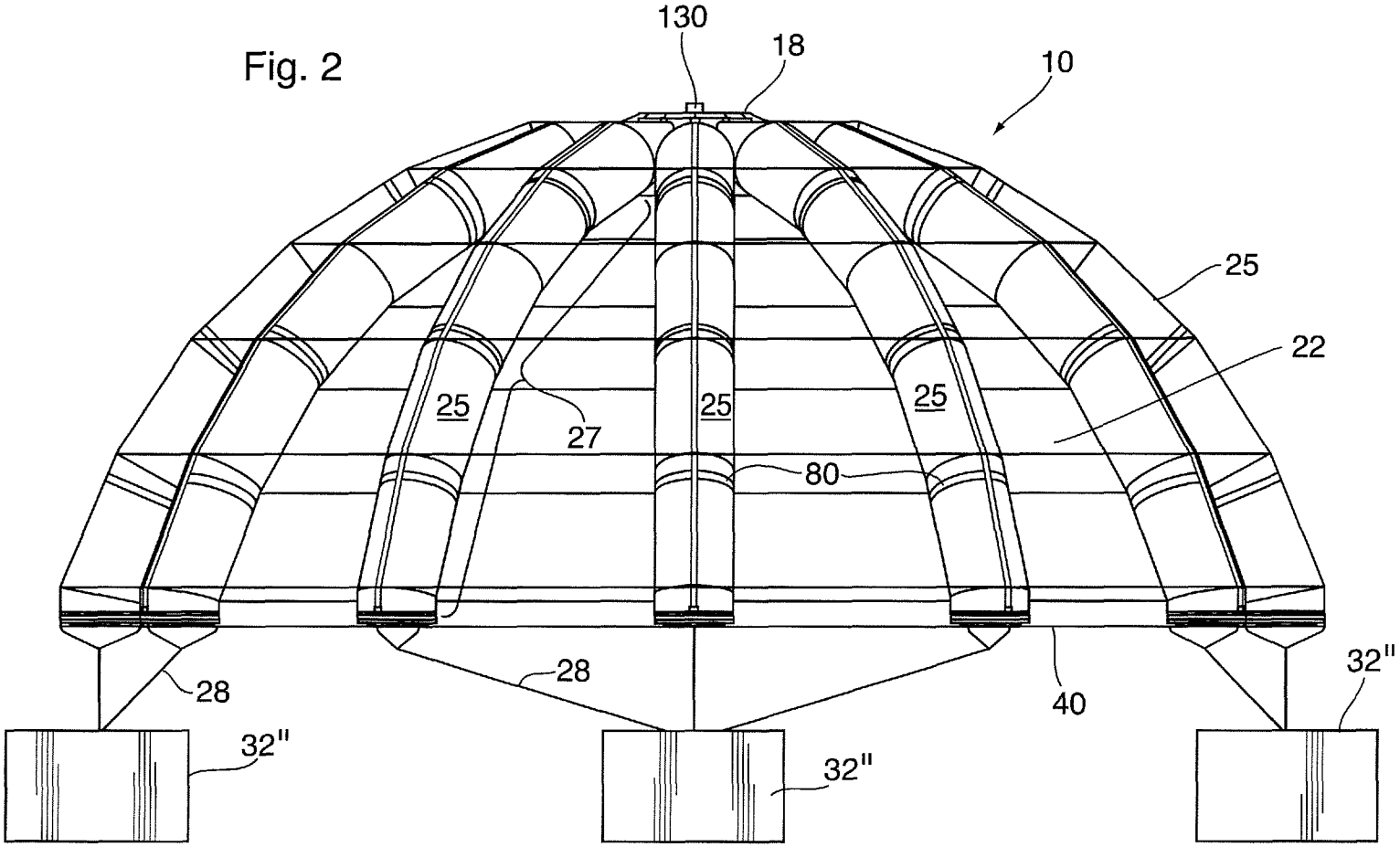
FIG. 2 is a side elevation view of the hemispherical dome structure of FIG. 1, shown without the riser for transporting collected oil from the interior of the hemispherical dome to surface.
Figure 3:
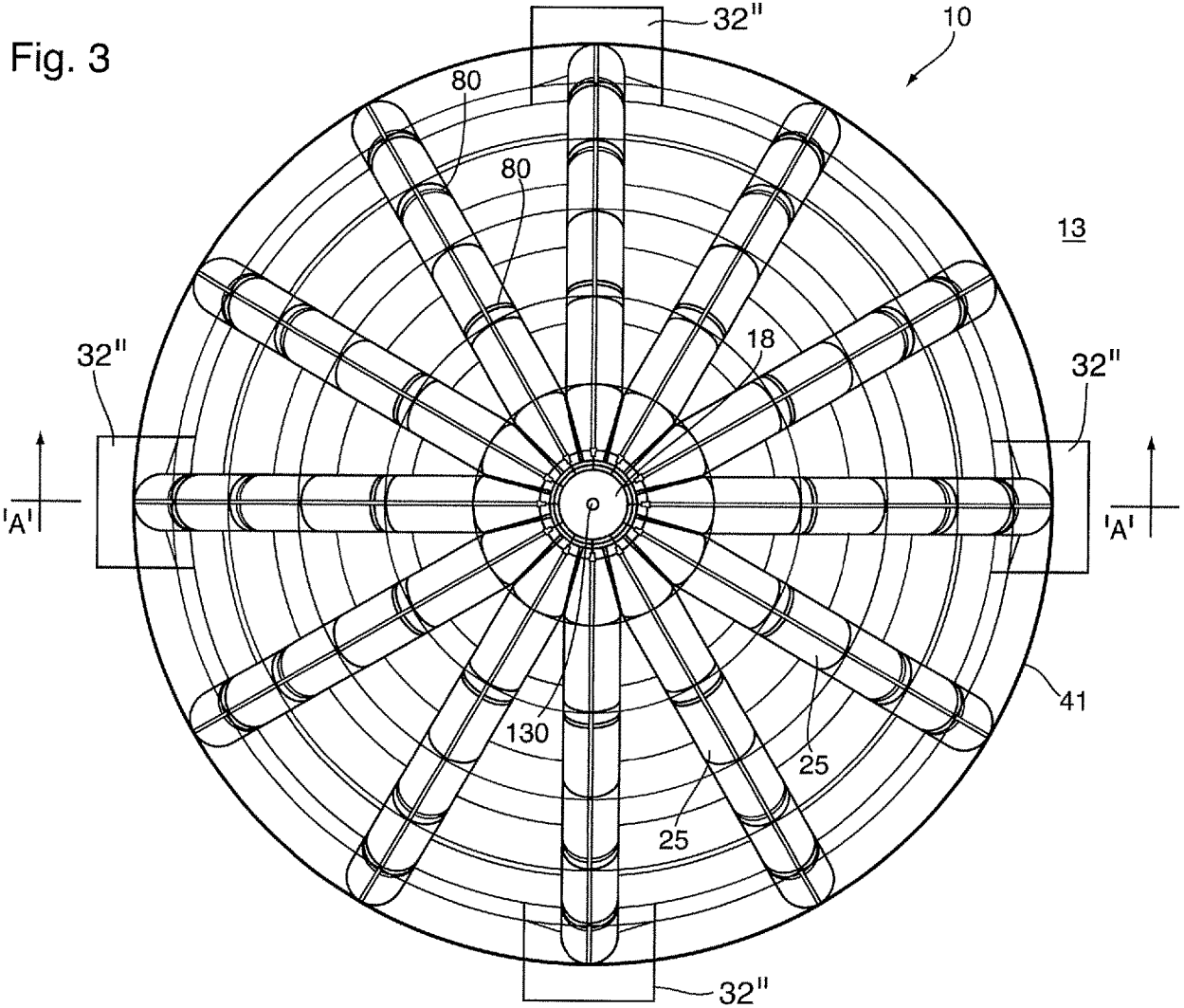
FIG. 3 is a top view of the hemispherical dome structure of FIG. 1 where such structure is used for collecting therewithin oil escaping from a compromised capped oil well, again omitting the riser for transporting collected oil from the interior of the hemispherical dome to surface.
Figure 4:
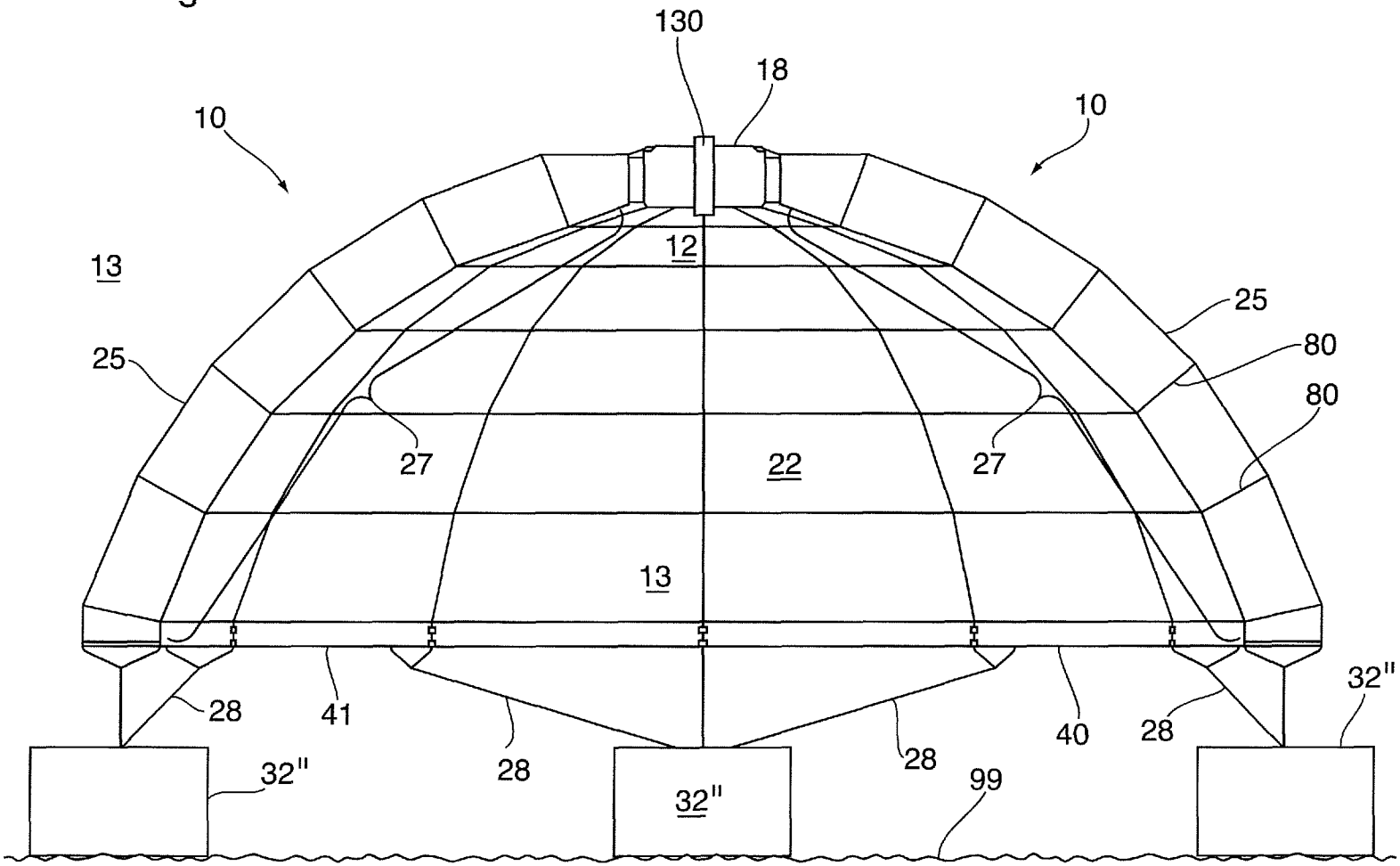
FIG. 4 is a cross-section through the hemispherical dome structure of FIG. 3 along plane 'A'-'A' of FIG. 3.
Figure 8:
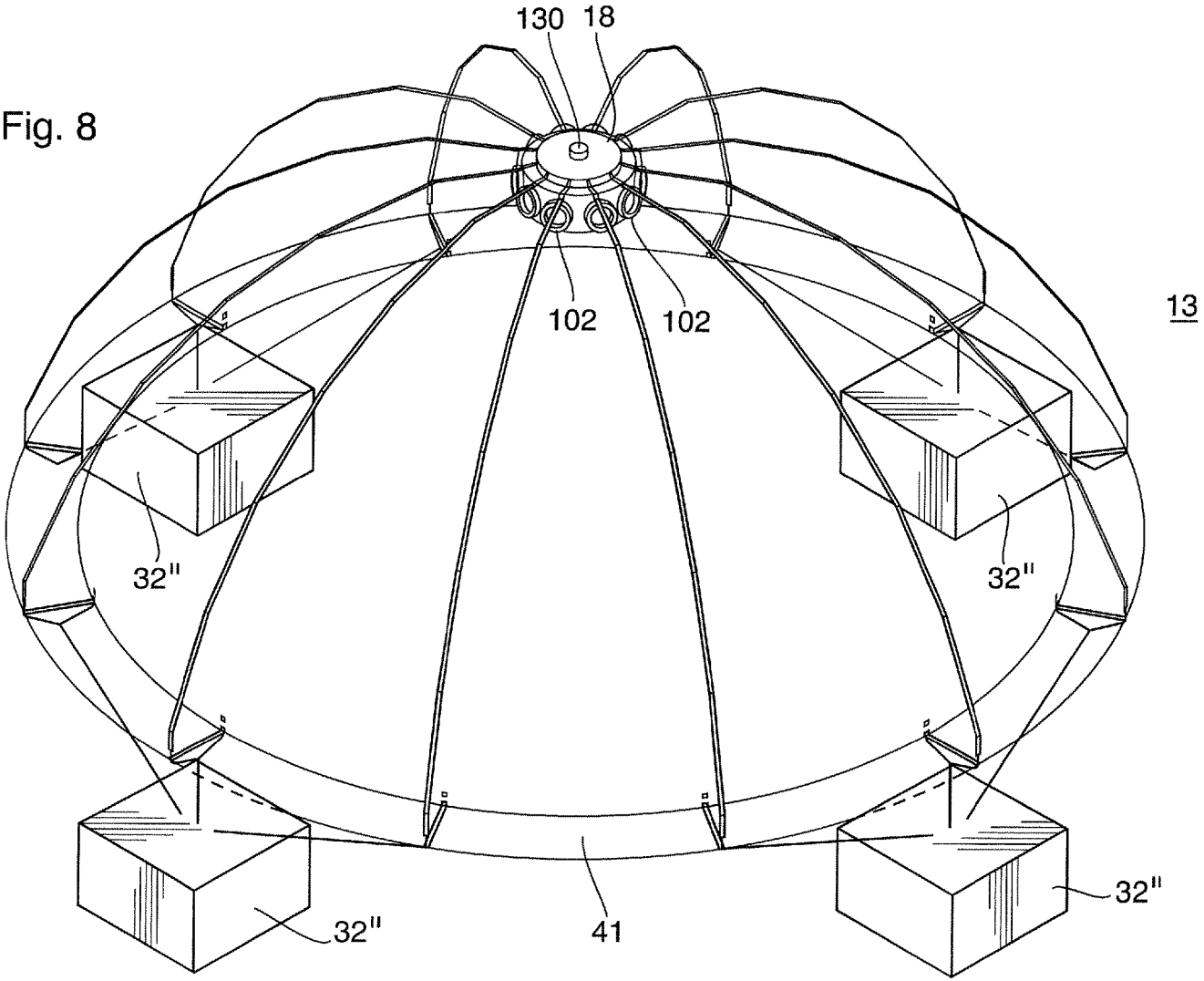
FIG. 8 is a partial perspective view of the hemispherical dome structure of the present invention, showing the central hub member and the anchor means, but with textile containment sheet removed for clarity and showing only the individual points of coupling of the beam members to the textile containment sheet.
Figure 9:
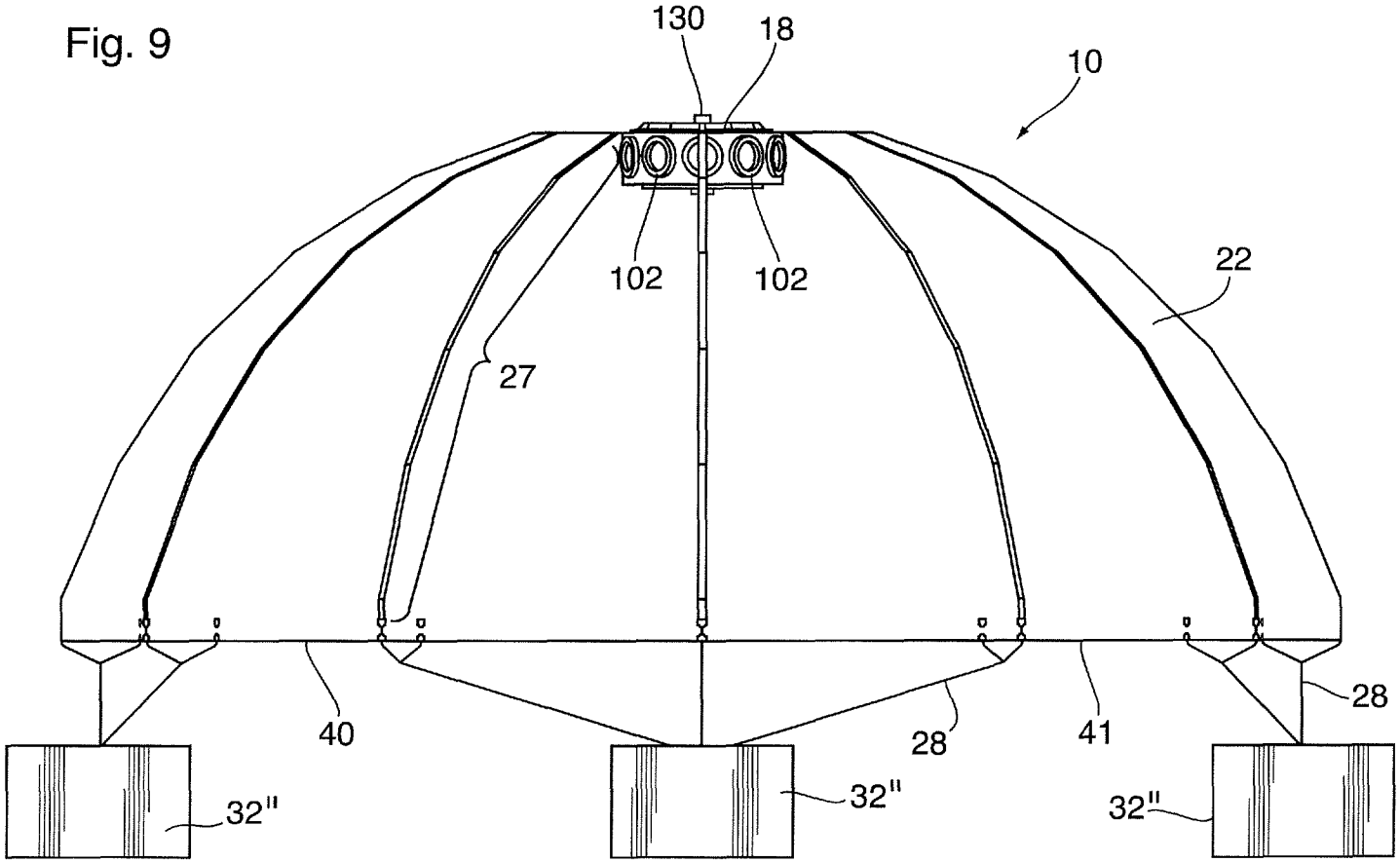
FIG. 9 is a side elevation view of the hemispherical dome structure of FIG. 8.

Textile containment sheeting 22 is affixed to beam members 25 at discrete points (not shown) or continuously along a longitudinal length 27 of each inflatable beam member 25 (ref. FIGS. 1, 2, and 8).

In the embodiment shown in FIGS. 2-6, if desired, an external fly (not shown) in the form of a further flexible textile sheeting may further be placed over and external to beam members 25, so that the hemispherical dome structure 10 further assumes the external appearance of the dome 10 shown in FIG. 7. Inflatable beam members 25 may similarly further be attached at discrete points or along a longitudinal length 27 thereof, in the similar manner by which such beams 25 are coupled to textile containment sheeting 22.

Likewise, with regard to the embodiment shown in FIG. 7 where the inflatable beam members 25 underlie textile containment sheet 22, and internal fly (not shown) may be applied to an underside of inflatable beams 25, to provide a secondary manner of preventing leakage of collected first fluids from within hemispherical dome structure 10.

Textile containment sheet 22 is preferably impervious or substantially impervious to the (first) fluid being collected therewithin, which as mentioned above, is typically oil and gaseous hydrocarbons. As such hydrocarbons may further contain toxic and acidic gases such as hydrogen sulfide, it is further preferable that such textile containment sheeting be impregnated with waxes or other protective compounds to insulate the fibres thereof from such acidic gases and thereby better resist decomposition thereof. By having the above configuration and manner of construction, beam members 25 when inflated and tethered (in the manner hereinafter explained) are thus able to support textile containment sheet 22 in a downwardly-curved hemispherical dome enclosure shape, having an open bottom side 40.

One or more anchor members 32 are further provided, to allow textile containment sheet 22 and/or beam members to be tethered thereto, via rope, chain, or cables 28, to retain the textile containment sheet 22 and beam members proximate to and in a desired position around and directly above the point of compromise of sub-sea structure 16. Such one or more anchor members 32 may comprise a single unitary structure 32' of substantial mass, typically but not necessarily of cylindrical in shape, which is adapted to rest on the ground or a sea-bed floor 99, as shown in FIG. 5. The hollow open interior 33 of such unitary anchor member 32 thereof is of a size sufficient to encircle or substantially surround compromised structure 16 which is leaking/spewing said first fluids 12, as shown in FIG. 5. Textile containment sheet 22 and/or beam members 25 may be tethered to unitary anchor member 32' via rope, chain, or cable members 28, as shown for example in FIGS. 5 & 6. Preferably anchor members 32 are formed of cast concrete which is particularly suitable for anchoring containment structure 10 to the seabed floor 99 due to its high density and the ability to cast attachment points 77 within such concrete for attaching the tethers 28 on an upperside of such anchor members 32, but other high density anchor members may instead be used. For example, anchor members 32 may comprise steel spikes or pegs, adapted for being driven into the seabed floor 99, having a protruding end to which tethers 28 may be secured.

Alternatively, one or more anchor members 32 may comprise a plurality of anchor members 32". In such embodiment one or both of textile containment sheeting 22 and/or one or more beam members 25 may be tethered via tether means 28 such as a rope, chain, or cable member to such anchor members 32" as shown in FIGS. 1-4 and FIGS. 7-9, so as to secure the hemispherical dome in position around and above leaking undersea structure 16.

A fluid exit port 130 may be located at the crown or apex of the containment structure 10 and typically located in the central hub 18, for allowing first fluids 12 flowing into the containment structure to rise and displace water downwardly, and thereafter be removed via pumping from such containment structure 10 to surface.

Beam members 25, when inflated with a second fluid 50, typically comprising water or air, and preferably a combination of both. Other gases other than air may be employed, such as carbon dioxide or nitrogen, for the purposes of pressurizing beam members 25 where added resiliency of such beam members is desired. Where containment structure is deployed at greater depths, greater gaseous inflation pressures are needed to withstand greater hydrostatic forces imposed on such beams with increased depths. Advantageously, to a limited extent the increased inflation pressures, particularly if such inflation of beam members is conducted at depth and not at surface, does not necessarily translate into inceased ball thickness of the inflatable beam members, as the increased inflation pressure will be offset by increased hydrostatic forces at depth. When second longitudinal ends 30 of beam members 25 thereof are tethered to anchor members 32, beam members 25 support textile containment sheet 22 in a downwardly-extending shape extending downwardly from said raised central hub 18, to form an enclosure 10 having an open bottom end 40 above compromised undersea structure 16.

In one embodiment, the containment structure 10 comprises a hemispherical dome, as best shown in FIGS. 1,3, 4 & 5, and beam members 25 extend radially outwardly therefrom and when second longitudinal ends 30 thereof are tethered to anchor members 32, extend downwardly in a curved manner from central hub 18. When such structure 10 is placed over a compromised subsea structure 16 and beam members 25 inflated, such beam members 25 support textile containment sheet 22 to which such beam members 25 are coupled, in a hemispherical dome shape having an open bottom end 40.

To allow inflation of beam members 25, in one embodiment each of said beam members are provided with a separate receptacle 70 for injection of the second fluid 50. Each of receptacles 70 are in fluid communication respectively with an interior of a corresponding of the inflatable beam members 75 and further having a fluid coupling means (not shown), typically a threaded fluid coupling as well known to persons of skill in the art, thereon to allow a supply hose (not shown) to be coupled to receptacle 70 and thereby permit the second fluid 50 to be pumped into each of said inflatable beam members 25. In such embodiment each receptacle 70 thereon further possessing a one-way valve 90 to allow said second fluid, once injected in a respective of said plurality of inflatable beam members 25, to be retained therein and prevented from escaping. Beam members 25 may be inflated at surface by supply of second fluid 50 to each of receptacles 70, or by an undersea submersible vessel individually and successively coupling a supply of said second fluid 50 to each receptacle 70.

Figure 11:
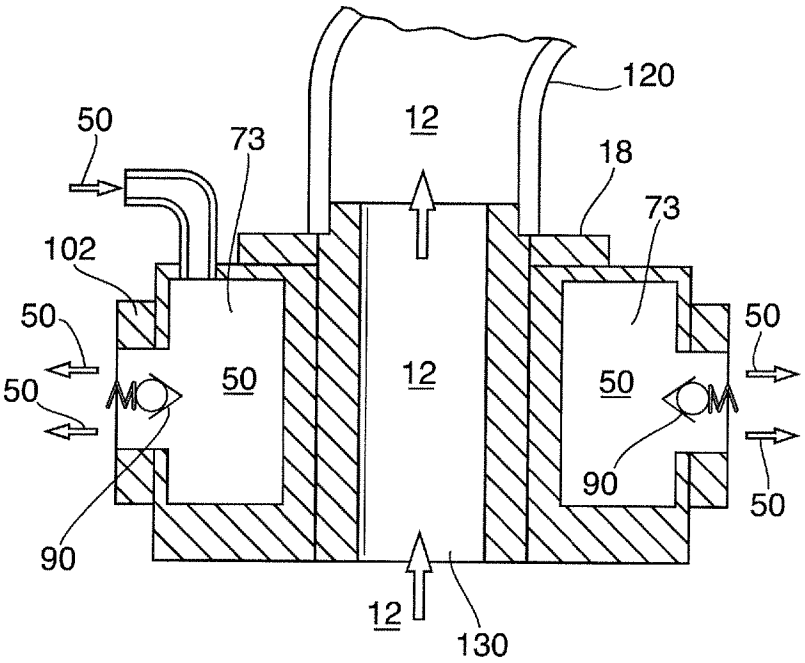
FIG. 11 is a cross-section taken along plane 'B'-'B' of FIG. 10.
Figure 10:
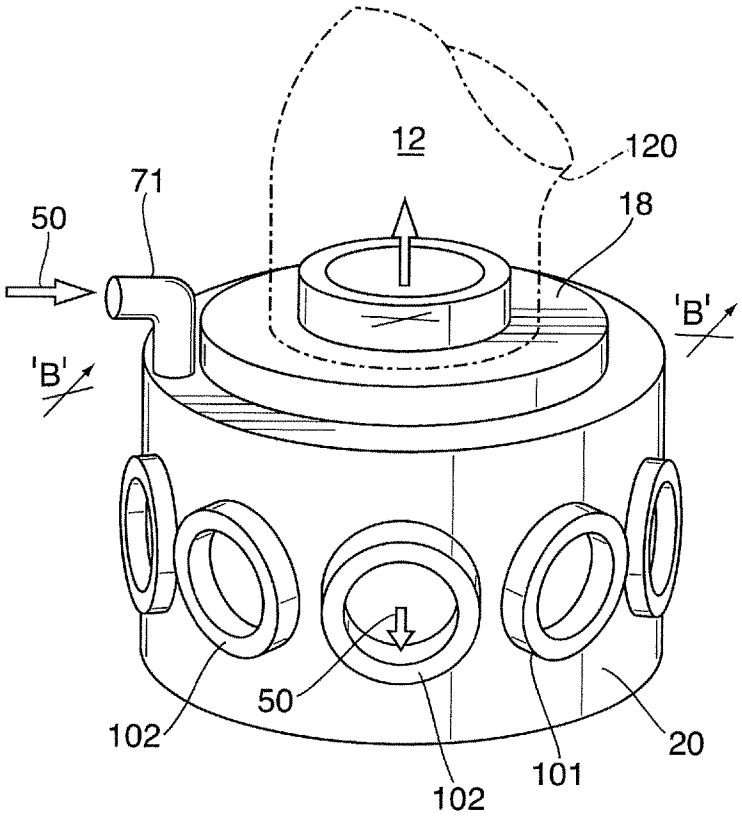
FIG. 10 is a perspective side view of one embodiment of the central hub member employed in the hemispherical dome structure of the present invention.
Figure 12:
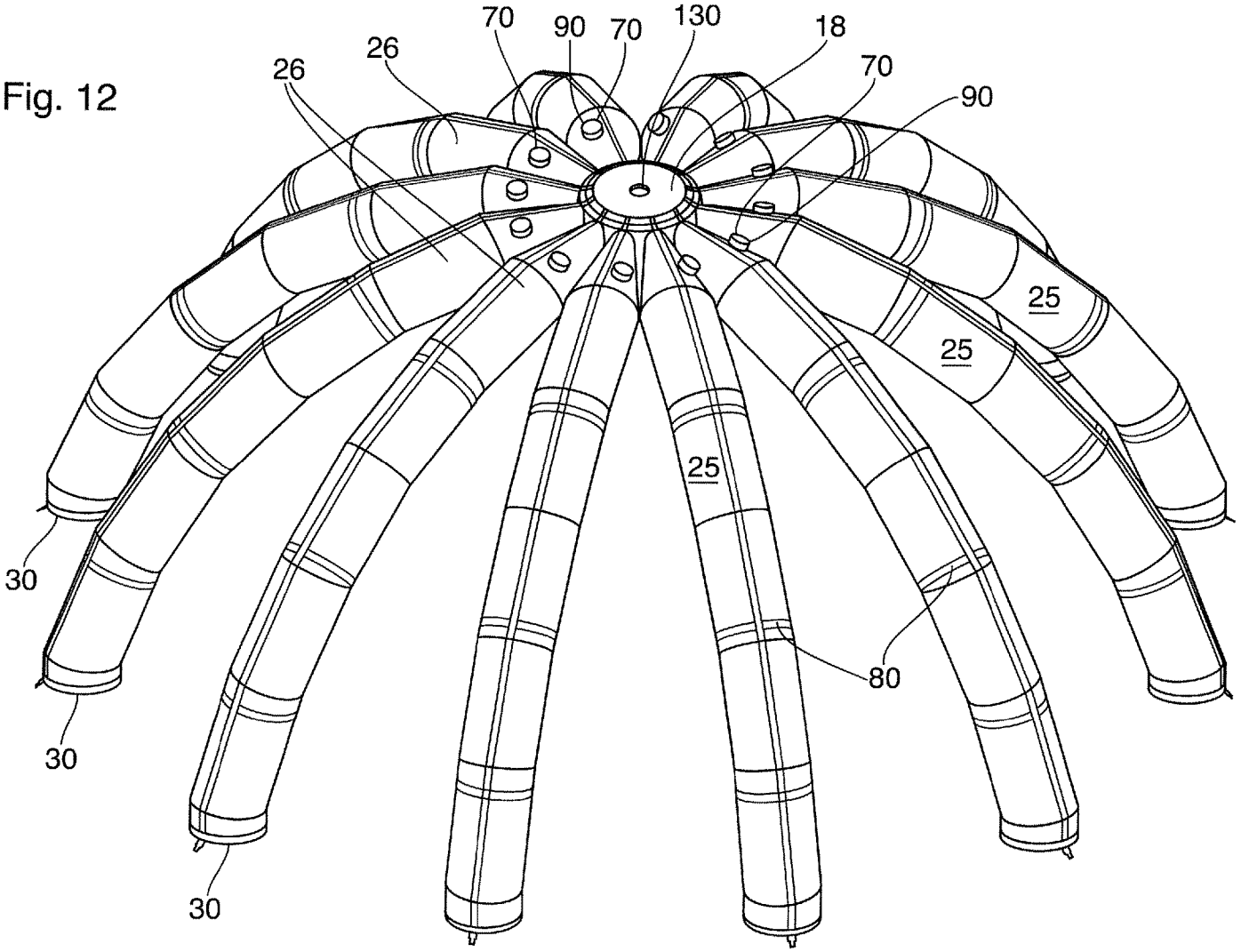
FIG. 12 is a view of the individual inflatable beam members, after inflation and where in fluid communication with the central hub member, where each beam member has a receptacle thereon for receiving a second fluid such as water, air, or a mixture thereof to allow inflation of the respective beam member.

More preferably, however, central hub 18 is provided with port means 101 thereon, In this regard, reference is to be had to FIGS. 10 & 11, showing this preferred configuration of central hub member 18. In such preferred embodiment, central hub 18 in addition to containing a fluid exit port 130 to allow removal of first fluids 12 from containment structure 10 further serves as a fluid distribution manifold for distributing second fluid 50 to each of beam members 25 to inflate same. In such embodiment central hub 18 is fluidly coupled to first longitudinal ends 26 of each of beam members 25. In such embodiment port means 101 comprises a plurality of ports 102 spaced about outer periphery 20 of central hub 18, such plurality of ports typically corresponding in number to the number of inflatable beam members 25. Each of ports 102 are coupled to and in fluid communication respectively with a first longitudinal end 26 of corresponding of inflatable beam members 25, and in fluid communication with each other via a communicating plenum 73. Supply of second fluid 50 via a supply hose (not shown) which is coupled to inlet spigot 71 on central hub 18 allows central hub 25 to simultaneously inflate beam members 25 via ports 102 therein. Such embodiment is particularly advantageous, as it allows the option of coupling a supply hose to inlet spigot 71 at surface, lowering the containment structure 10 so as to position it over the compromised structure 16, and inflating beam members 25 at depth and simultaneously, without the need for use of a submersible vessel to couple the fluid supply hose to each individual beam member 25.

To increase structural integrity and avoid loss of second fluids 50 from each beam member 25 in the event one of the individual beam members should spring a leak or be structurally compromised, in a preferred embodiment central hub 18 is provided with a plurality of one-way valves 90, preferably at the location of each of ports 102, as shown schematically in FIG. 11. Each of one-way valves 90 allow flow of second fluid 50 from within central hub 18 and plenum 73 thereof to a respective of inflatable beam members 25, but prevent reverse flow of second fluid from any of inflatable beam members 25 into central hub 18. One way valve members 90 may comprise any type of ball valve, flapper-type valve, or the like as are well known in the art which functions as a check valve to only allow supply of second fluids 50 to the individual beam members 25, and avoids depressurization of all beam members 25 in the event of a leak in one such beam member 25.

To facilitate removal of collected first fluids 12 from an interior of containment structure 10, a flexible, hollow, tubular fluid transport riser 120 is typically coupled to exterior surface of central hub 18, so as to receive and allow pumped removal of first fluids 12 via fluid exit port 130 in central hub 18. Central hub 18 is in fluid communication with an interior of containment enclosure 10 via fluid exit port 130. Riser 120 is preferably a flexible hose, and of a length sufficient to extend to surface to surface vessel 17, and allows pumping of first fluid 12 from an interior of said enclosure 10 to said surface.

In a preferred embodiment, inflatable beam members 25 are couple to textile containment sheet 22 by having disposed around a portion of a circumference thereof and in spaced-apart relation along a longitudinal length 27 of each a plurality of circumferential strap members 80. Each inflatable beam member 25 is coupled to textile containment sheet via a point of coupling on each of said plurality of circumferential strap members thereon.

Method for Containing and Recovering Fluids Leaking from a Compromised Subsea Structure The various manners of operation and methods for containing and recovering fluids leaking from a compromised subsea structure will now be described.

In one embodiment such method comprises the steps of:

(i) arranging at surface inflatable beam members 25 circumferentially around outer periphery 20 of central hub member 18 such that first longitudinal ends 26 thereof are coupled to said central hub member 18 and second mutually opposite longitudinal ends 30 thereof 25 extend radially outwardly from central hub member 18;

(ii) arranging central hub member 18 and inflatable beam members 25 such that they underly or overly textile containment sheet 22;

(iii) coupling inflatable beam members 25 to textile containment sheet 22 at discrete points or continuously along a longitudinal length 27 of each inflatable beam member 25;

(iv) attaching a first end of an elongate tubular riser 120 to central hub member 18, while maintaining a second, mutually opposite longitudinal end of said tubular riser 120 at surface;

(v) lowering the so-formed containment structure 10 within a body of water to at least partially overly a compromised sub-sea structure 16 that is leaking first fluid 12 into said body of water, so that said textile containment sheet 22 surrounds upper regions of said compromised structure 16;

(vi) inflating, after step (iv) or (v), inflatable beam members 25 with a second fluid 50 to form containment structure 10 with central hub member 18 situated at a crown or apex of containment structure 10;

(vii) anchoring the so-formed containment structure by tethering second longitudinal ends 30 of one or more of beam members 25 to one or more anchor members disposed about compromised subsea structure 16;

(viii) flowing first fluid 12 into regions underlying said textile containment sheet 22, namely into the interior of containment structure 10 via the open bottom 40 therein; and (ix) withdrawing, at a location proximate a crown or apex of containment structure 10, the first fluid 12 from within an interior of said containment structure 10 via said tubular riser 120, and pumping first fluid 12 to surface vessel 17.

In a further embodiment, the step of attaching the one or more anchor members 32 to said second mutually opposite longitudinal ends 30 of each of inflatable beam members 25 is conducted at surface and prior to lowering textile containment sheet 22, inflatable beam members 25, and central hub member 18 within said body of water to overly at least portions of said compromised sub-sea structure 16.

In an alternative further embodiment, the step of attaching the one or more anchor members 32 to the second mutually opposite longitudinal ends 30 of each of inflatable beam members 25 is conducted at depth, and after lowering textile containment sheet 22, inflatable beam members 25, and central hub member 18 within said body of water to overly at least portions of said compromised sub-sea structure 16.

In a further alternative method, inflatable beam members 25 are inflated with second fluid 50 at surface and prior lowering textile containment sheet 22, inflatable beam members 25, and central hub member 18 within the body of water.

In a further alternative method, inflatable beam members 25 are inflated subsea after having lowered textile containment sheet 22, inflatable beam members 25, and central hub member 18 within the body of water so as to at least partially overly said compromised sub-sea structure 16, and after having attached anchor means 32 to the second longitudinal ends of inflatable beam members 25. Such embodiment is particularly advantageous when employed with a central hub 18 having ports 102 thereon coupled to and in fluid communication with first longitudinal ends and having fluid inlet spigot 71 thereon coupled to a fluid supply hose supplying second fluid 50. In such manner beam members 25 may be inflated and containment structure 10 erected upon fluid supply hose supplying second fluids 50 from surface.

In the embodiment where instead the central hub member 18 is not provided with ports and instead each of beam members 25 are provided with a receptacle 25 for receiving second fluids 50, the method may comprise utilizing an undersea submersible vessel (not shown) which is configured to allow supply of second fluid 50 to the receptacles 70.

Use of examples in the specification, including examples of terms, is for illustrative purposes only and is not intended to limit the scope and meaning of the embodiments of the invention set out and described in the disclosure. Numeric ranges are inclusive of the numbers defining the range. In the specification, the word "comprising" is used as an open-ended term, substantially equivalent to the phrase "including, but not limited to," and the word "comprises" has a corresponding meaning.

The scope of the claims should not be limited by the preferred embodiments set forth in the foregoing examples, but should be given the broadest interpretation consistent with the description as a whole, and the claims are not to be limited to the preferred or exemplified embodiments of the invention.

The embodiments in which an exclusive property and privilege is claimed are set out in the following claims:

1. A containment structure (10) for underwater use having a central elevated portion and an open bottom end, comprising:

(i) a textile containment sheet (22) substantially impervious to a first fluid (12);

(ii) a central hub (18) situated centrally on said textile containment sheet (22) and having an outer periphery (20);

(iii) a support comprising a plurality of elongate inflatable beam members (25), first longitudinal ends (26) thereof arranged circumferentially around said outer periphery (20) of said central hub (18), said inflatable beam members (25) each extending radially outwardly and in a downwardly-extending manner from said central hub (18) and each underlying or overlying said textile containment sheet (22) and each coupled to said textile containment sheet (22) at one or more intervals or continuously along a longitudinal length (27) of each of said inflatable beam members (25) and thereby supporting said textile containment sheet (22);

(iv) one or more anchor members (32), each of said plurality of inflatable beam members (25) proximate a second longitudinal end (30) thereof opposite said first longitudinal end (26) being tethered, via rope, cable, or chain members (28), to said one or more anchor members (32); and (v) a fluid exit port (130) located in or at said central hub, for removing said first fluid (12) from within said containment structure (10);

wherein said inflatable beam members (25) are each individually inflatable and when inflated with a second fluid (50) and when said second longitudinal ends (30) thereof are tethered to said one or more anchor members (32), together support said textile containment sheet (22) in a downwardly-extending shape extending downwardly from said central hub, to form an enclosure having an open bottom end (40); and wherein, when said inflatable beam members are inflated, said containment structure is radially resiliently deformable from said open bottom end to said central hub.

2. The containment structure as claimed in claim 1, wherein each of said inflatable beam members are provided with a separate receptacle (70) for injection of said second fluid (50), each of said receptacles in fluid communication respectively with an interior of a corresponding of said inflatable beam members and further having a fluid coupling means (71) thereon to allow a supply hose to be coupled to such receptacle (70) and thereby permit said second fluid (50) to be pumped into each of said inflatable beam members, each receptacle thereon further possessing a one-way valve (90) to allow said second fluid, once injected in a respective of said plurality of inflatable beam members, to be retained therein and prevented from escaping.

3. The containment structure as claimed in claim 1, wherein said central hub (18) has port means (101) located on said outer periphery (20) thereof, said port means (101) configured to provide said second fluid to an interior of at least one of said inflatable beam members.

4. The containment structure as claimed in claim 3, wherein said port means comprises a plurality of ports (102) corresponding in number to said plurality of inflatable beam members arranged in spaced relation around said outer periphery of said central hub, each of said plurality of ports (102) configured to provide said second fluid to an interior of a corresponding of said plurality of inflatable beam members.

5. The containment structure as claimed in claim 1 wherein said one or more anchor members comprise one or more cast concrete members.

6. The containment structure as claimed in claim 1 wherein said inflatable beam members are coupled to said textile containment sheet via a point of coupling on a plurality of circumferential strap members (110) disposed along said longitudinal length of each of said inflatable beam members.

7. The containment structure as claimed in claim 1, further comprising:

a flexible, hollow, tubular fluid transport riser (120), in fluid communication with an interior of said enclosure, configured and of a length sufficient to extend to surface when said containment structure is submerged sub-sea, to transport said first fluid from an interior of said enclosure to said surface.

8. The containment structure as claimed in claim 1, wherein said central hub (18) comprises:

a plurality of ports (102) spaced about the outer periphery (20) and corresponding in number to the number of said inflatable beam members (25), each port (102) being coupled to and in fluid communication with the first longitudinal end (26) of a respective one of the inflatable beam members (25), the plurality of ports (102) being configured to provide said second fluid (50) to an interior of each of said inflatable beam members (25) for simultaneously inflating said inflatable beam members (25); and an inlet spigot (71) arranged to couple to a supply hose to provide a supply of said second fluid.

9. A hemispherical sub-sea dome structure (10) for containing and temporarily collecting therewithin a first fluid (12) which is escaping from a compromised under-sea structure (16) selected from the group of under-sea structures comprising an under-sea pipeline, an under-sea valve, an under-sea oil well, and a sunken transport vessel, comprising:

(i) a textile containment sheet (22) substantially impermeable to said first fluid (12);

(ii) a central hub (18), having an outer periphery (20), situated centrally on said textile containment sheet (22);

(iii) a support comprising a plurality of elongate inflatable beam members (25) each having a first longitudinal end (26) and arranged circumferentially around said outer periphery (20) of said central hub (18), said inflatable beam members (25) each extending radially outwardly and in a downwardly-curved manner from said central hub (18) and each underlying or overlying said textile containment sheet (22) and coupled thereto at discrete points along a longitudinal length (27) of each inflatable beam member (25) for supporting said textile containment sheet (22) in a downwardly-curved hemispherical dome shape to form a hemispherical enclosure having an open bottom end (40);

(iv) one or more anchor members (32) disposed in spaced relation about a circular base portion (41) of said textile containment sheet (22), said one or more anchor members tethered to one or more of said inflatable beam members (25) proximate a second longitudinal end (30) thereof opposite said first longitudinal end (26);

wherein said plurality of inflatable beam members (25) are each individually inflatable and when inflated with a second fluid (50) and when said second longitudinal ends (30) thereof are tethered to said one or more anchor members (32), together support said textile containment sheet (22) in said hemispherical dome shape; and wherein, when said inflatable beam members are inflated, said hemispherical enclosure is radially resiliently deformable from said open bottom end to said central hub.

10. The hemispherical sub-sea dome structure as claimed in claim 9, wherein each of said inflatable beam members are provided with a separate receptacle (70) for injection of said second fluid, each of said receptacles in fluid communication respectively with an interior of a corresponding of said inflatable beam members and further having a fluid coupling means (72) thereon to allow a supply hose to be coupled to such receptacle and thereby permit said second fluid to be pumped into each of said inflatable beam members, each receptacle thereon further possessing a one-way valve (90) to allow said second fluid, once injected in a respective of said plurality of inflatable beam members, to be retained therein and prevented from escaping.

11. The hemispherical dome containment structure as claimed in claim 9, wherein said central hub has port means located on said outer periphery thereof, said central hub coupled to a supply of said second fluid and configured to provide said second fluid to selected of said inflatable beam members to thereby inflate said inflatable beam members with said second fluid via said port means.

12. The hemispherical sub-sea dome structure as claimed in claim 11, said port means comprising a plurality of ports spaced about said outer periphery of said central hub, said plurality of ports corresponding in number to said plurality of inflatable beam members and each of said ports coupled to and in fluid communication respectively with a first longitudinal end of corresponding of said plurality of inflatable beam members, said central hub configured to inflate said beam members via said ports when said ports are supplied with said second fluid.

13. The hemispherical sub-sea dome structure as claimed in claim 9, wherein said central hub is coupled to an elongate fluid supply hose, and said central hub, when supplied with said second fluid via said fluid supply hose, is configured to provide said second fluid to an interior of each of said inflatable beam members via said central hub so as to inflate said inflatable beam members.

14. The hemispherical sub-sea dome structure as claimed in claim 13, wherein said central hub (18), when supplied with said second fluid comprising air via said fluid supply hose is configured to provide said second fluid to an interior of each of said inflatable beam members so as to pressurize said inflatable beam members at a uniform pressure.

15. The hemispherical sub-sea dome structure as claimed in claim 9, further comprising:

a flexible, tubular riser (120), in fluid communication with an interior of said hemispherical sub-sea dome structure, configured and of a length sufficient to extend to surface when said hemispherical sub-sea dome structure is submerged sub-sea, to transport said first fluid from an interior of said hemispherical sub-sea dome structure to said surface.

16. The hemispherical sub-sea dome structure as claimed in claim 15, wherein said tubular riser is coupled to said central hub and extends upwardly from said central hub, said central hub having an aperture (130) therein permitting flow of said first fluid from within said hemispherical dome structure through said central hub and into said riser.

17. The hemispherical sub-sea dome structure as claimed in claim 9, wherein said central hub is provided with a plurality of one-way valves (90), each of said plurality of one-way valves allowing flow of said second fluid from within said central hub to a respective of said inflatable beam members, but preventing reverse flow of said second fluid from said inflatable beam members into said central hub.

18. The hemispherical sub-sea dome structure as claimed in claim 9, wherein said inflatable beam members are cylindrical and each have disposed around a portion of a circumference thereof and in spaced-apart relation along said longitudinal length of each, a plurality of circumferential strap members, each inflatable beam member coupled to said textile containment sheet via a point of coupling on each of said plurality of circumferential strap members thereon.

19. The hemispherical sub-sea dome structure as claimed in claim 9, wherein said central hub (18) comprises:

a plurality of ports (102) spaced about the outer periphery (20) and corresponding in number to the number of said inflatable beam members (25), each port (102) being coupled to and in fluid communication with the first longitudinal end (26) of a respective one of the inflatable beam members (25), the plurality of ports (102) being configured to provide said second fluid (50) to an interior of each of said inflatable beam members (25) for simultaneously inflating said inflatable beam members (25); and an inlet spigot (71) arranged to couple to a supply hose to provide a supply of said second fluid.

20. A containment structure (10) for underwater use having a central elevated portion and an open bottom end, comprising:

(i) a textile containment sheet (22) substantially impervious to a first fluid (12);

(ii) a central hub (18) situated centrally on said textile containment sheet (22) and having an outer periphery (20);

(iii) a support comprising a plurality of elongate inflatable beam members (25), first longitudinal ends (26) thereof arranged circumferentially around said outer periphery (20) of said central hub (18), said inflatable beam members (25) each extending radially outwardly and in a downwardly-extending manner from said central hub (18) and each underlying or overlying said textile containment sheet (22) and each coupled to said textile containment sheet (22) at one or more intervals or continuously along a longitudinal length (27) of each of said inflatable beam members (25) and thereby supporting said textile containment sheet (22);

(iv) one or more anchor members (32), each of said plurality of inflatable beam members (25) proximate a second longitudinal end (30) thereof opposite said first longitudinal end (26) being tethered, via rope, cable, or chain members (28), to said one or more anchor members (32); and (v) a fluid exit port (130) located in or at said central hub, for removing said first fluid (12) from within said containment structure (10);

wherein said inflatable beam members (25), when inflated with a second fluid (50) and when said second longitudinal ends (30) thereof are tethered to said one or more anchor members (32), together support said textile containment sheet (22) in a downwardly-extending shape extending downwardly from said central hub, to form an enclosure having an open bottom end (40);

wherein, when said inflatable beam members are inflated, said containment structure is radially resiliently deformable from said open bottom end to said central hub; and wherein each of said inflatable beam members are provided with a separate receptacle (70) for injection of said second fluid (50), each of said receptacles in fluid communication respectively with an interior of a corresponding of said inflatable beam members and further having a fluid coupling means (71) thereon to allow a supply hose to be coupled to such receptacle (70) and thereby permit said second fluid (50) to be pumped into each of said inflatable beam members, each receptacle thereon further possessing a one-way valve (90) to allow said second fluid, once injected in a respective of said plurality of inflatable beam members, to be retained therein and prevented from escaping.

21. The containment structure as claimed in claim 20 wherein said inflatable beam members are coupled to said textile containment sheet via a point of coupling on a plurality of circumferential strap members (110) disposed along said longitudinal length of each of said inflatable beam members.

22. The containment structure as claimed in claim 20, wherein said central hub (18) comprises:

a plurality of ports (102) spaced about the outer periphery (20) and corresponding in number to the number of said inflatable beam members (25), each port (102) being coupled to and in fluid communication with the first longitudinal end (26) of a respective one of the inflatable beam members (25), the plurality of ports (102) being configured to provide said second fluid (50) to an interior of each of said inflatable beam members (25) for simultaneously inflating said inflatable beam members (25); and an inlet spigot (71) arranged to couple to a supply hose to provide a supply of said second fluid.

23. A hemispherical sub-sea dome structure (10) for containing and temporarily collecting therewithin a first fluid (12) which is escaping from a compromised under-sea structure (16) selected from the group of under-sea structures comprising an under-sea pipeline, an under-sea valve, an under-sea oil well, and a sunken transport vessel, comprising:

(i) a textile containment sheet (22) substantially impermeable to said first fluid (12);

(ii) a central hub (18), having an outer periphery (20), situated centrally on said textile containment sheet (22);

(iii) a support comprising a plurality of elongate inflatable beam members (25) each having a first longitudinal end (26) and arranged circumferentially around said outer periphery (20) of said central hub (18), said inflatable beam members (25) each extending radially outwardly and in a downwardly-curved manner from said central hub (18) and each underlying or overlying said textile containment sheet (22) and coupled thereto at discrete points along a longitudinal length (27) of each inflatable beam member (25) for supporting said textile containment sheet (22) in a downwardly-curved hemispherical dome shape to form a hemispherical enclosure having an open bottom end (40);

(iv) one or more anchor members (32) disposed in spaced relation about a circular base portion (41) of said textile containment sheet (22), said one or more anchor members tethered to one or more of said inflatable beam members (25) proximate a second longitudinal end (30) thereof opposite said first longitudinal end (26);

wherein said plurality of inflatable beam members (25), are each individually inflatable and when inflated with a second fluid (50) and when said second longitudinal ends (30) thereof are tethered to said one or more anchor members (32), together support said textile containment sheet (22) in said hemispherical dome shape;

wherein, when said inflatable beam members are inflated, said hemispherical enclosure is radially resiliently deformable from said open bottom end to said central hub; and wherein said central hub is provided with a plurality of one-way valves (90), each of said plurality of one-way valves allowing flow of said second fluid from within said central hub to a respective of said inflatable beam members, but preventing reverse flow of said second fluid from said inflatable beam members into said central hub.

24. The hemispherical sub-sea dome structure as claimed in claim 23, wherein each of said inflatable beam members are provided with a separate receptacle (70) for injection of said second fluid, each of said receptacles in fluid communication respectively with an interior of a corresponding of said inflatable beam members and further having a fluid coupling means (72) thereon to allow a supply hose to be coupled to such receptacle and thereby permit said second fluid to be pumped into each of said inflatable beam members, each receptacle thereon further possessing a one-way valve (90) to allow said second fluid, once injected in a respective of said plurality of inflatable beam members, to be retained therein and prevented from escaping.

25. The hemispherical sub-sea dome structure as claimed in claim 23, wherein said inflatable beam members are cylindrical and each have disposed around a portion of a circumference thereof and in spaced-apart relation along said longitudinal length of each, a plurality of circumferential strap members, each inflatable beam member coupled to said textile containment sheet via a point of coupling on each of said plurality of circumferential strap members thereon.

26. The hemispherical sub-sea dome structure as claimed in claim 23, wherein said central hub (18) comprises:

a plurality of ports (102) spaced about the outer periphery (20) and corresponding in number to the number of said inflatable beam members (25), each port (102) being coupled to and in fluid communication with the first longitudinal end (26) of a respective one of the inflatable beam members (25), the plurality of ports (102) being configured to provide said second fluid (50) to an interior of each of said inflatable beam members (25) for simultaneously inflating said inflatable beam members (25); and an inlet spigot (71) arranged to couple to a supply hose to provide a supply of said second fluid.

* * * * *